United States Patent [19]

Malloy

[11] Patent Number: 4,910,802

[45] Date of Patent: Mar. 27, 1990

[54] EXERCISE SUIT

[76] Inventor: Eugene A. Malloy, 15988 Village Dr., Victorville, Calif. 92392

[21] Appl. No.: 268,084

[22] Filed: Nov. 7, 1988

[51] Int. Cl.[4] ..... A41D 1/00

[52] U.S. Cl. ..... 2/69; 2/79; 2/227; 272/119; 272/139

[58] Field of Search ..... 2/69, 79, 227, 115, 2/102, 233, 80, 22; 272/120, 136, 119, 139

[56] References Cited

U.S. PATENT DOCUMENTS

| | | | |
|---|---|---|---|
| 2,097,376 | 10/1937 | Marshman | 272/139 |
| 2,431,811 | 12/1947 | Lang | 2/79 |
| 2,568,304 | 9/1951 | Schoenbrun | 2/80 |
| 3,295,517 | 1/1967 | Stevens | 2/22 |
| 4,065,814 | 1/1978 | Fox | 2/227 |
| 4,303,239 | 12/1981 | Walsh | 272/119 |
| 4,344,620 | 8/1982 | Debski | 272/119 |
| 4,384,369 | 5/1983 | Prince | 2/79 |
| 4,407,497 | 10/1983 | Gracie | 272/119 |
| 4,658,442 | 4/1987 | Tomlinson | 2/94 |

*Primary Examiner*—Werner H. Schroeder
*Assistant Examiner*—Diana L. Biefeld
*Attorney, Agent, or Firm*—Leon Gilden

[57] ABSTRACT

An exercise suit apparatus is set forth wherein a suit of unitary construction is presented to envelop a human figure from the neck to the feet. The suit includes a plurality of elastic bands associated with each human appendage positioned on opposed sides of the arm portions of the suit and overlying a forward, side and back portion of each leg portion of the suit with a medially positioned elastic band securing the user's waist with an additional band about the user's chest. A zipper is positioned vertically onto a rearward surface of the suit for enabling entry of the suit by an individual. The various bands are positioned within enclosed conduits with the conduits for each band including a spaced region for enabling an adjustment buckle to adjust tension for each band.

2 Claims, 1 Drawing Sheet

10
11
12
13
13a
14
14a
15
15a
16
16a
17
17a
18
18a
19
19a
20
20a
21
21a
22
24
25
25a
26
26a
27
27a
28
28a
29
30
31
32
33

EXERCISE SUIT

BACKGROUND OF THE INVENTION

1. Field of the Invention

The field of invention relates to exercise suits, and more particularly pertains to a new and improved exercise suit that includes a plurality of elastic bands for adjusting tension to selectively exercise the various portions of the human body at predetermined rates.

2. Description of the Prior Art

The use of various exercise devices to enhance physical fitness is well known in the prior art. Traditionally these devices have included cumbersome exercist apparatus or in the utilization of suit arrangements, these suits have been of elaborate and cumbersome construction to provide exercise for an individual wearer. For example, U.S. Pat. No. 4,384,369 to Prince sets forth an exercise suit provided with pockets overlying the suit at various portions thereof to enable the pockets to contain liquid bags to exercise and massage the muscles associated with each portion of the suit. The Prince device is of a cumbersome and elaborate organization, as opposed to that of the instant invention.

U.S. Pat. No. 3,303,239, to Walsh sets forth a thigh muscle exercise device including a belt formed with a series of weight suspension portions associated with the belt to enable adjustment of the weight to accommodate an individual's exercise aptitudes.

U.S. Pat. No. 4,344,620 to Debski sets forth an exercise vest provided with various compartments to contain water and other fluid removably introduced into the compartments with air introduced into the compartments to occupy space not occupied by water in order to fill out the vest to desired proportions to enable exercise of an associated individual at a desired rate.

U.S. Pat. No. 4,407,497 to Gracie sets forth a weighted exercise suit wherein weight strips are removably attached to the suit overlying the shoulders wherein each strip contains compartments to hold weights to balance the distribution of weights about a wearer.

U.S. Pat. No. 4,658,442 to Tomlinson set forth an exercise vest for securement of various weights therein for exercise of the associated individual.

As such, it may be appreciated that there continues to be a need for a new and improved exercise suit that is of compact and effective construction for the exercise of an individual.

SUMMARY OF THE INVENTION

In view of the foregoing disadvantages inherent in the known types of exercise clothing now present in the prior art, the present invention provides an exercise suit wherein the same is configured and arranged for covering a major portion of the human exterior and is provided with adjustable tension means for varying the degree of exercise to be effected. As such, the general purpose of the present invention, which will be described subsequently in greater detail, is to provide a new and improved exercise suit which has all the advantages of the prior art exercise garments and none of the disadvantages.

To attain this, the present invention comprises a body suit for overlying the entirety of the human exterior surface below the neck and is provided with a plurality of elongate elastic bands extending on various sides of the human appendages and provided with tensioning devices for adjusting the degree of tension in each band. The bands are positioned within conduits integrally secured to an overlying the suit surface to minimize skin irritation to a wearer.

My invention resides not in any one of these features per se, but rather in the particular combination of all of them herein disclosed and claimed and it is distinguished from the prior art in this particular combination of all of its structures for the functions specified.

There has been thus outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved exercise suit which has all the advantages of the prior art exercise suits and none of the disadvantages.

It is another object of the present invention to provide a new and improved exercise suit which may be easily and efficiently manufactured and marketed.

It is a further object of the present invention to provide a new and improved exercise suit which is of a durable and reliable construction.

An even further object of the present invention is to provide a new and improved exercise suit which is susceptible of a low cost of manufacture with regard to both materials and labor, and which accordingly is then susceptible of low prices of sale to the consuming public, thereby making such exercise suit economically available to the buying public.

Still yet another object of the present invention is to provide a new and improved exercise suit which provides in the apparatuses and methods of the prior art some of the advantages thereof, while simultaneously overcoming some of the disadvantages normally associated therewith.

Still another object of the present invention is to provide a new and improved exercise suit wherein the same is provided with a series of elastic bands that may be adjustably arranged to vary the degree of exercise in the various portions of the human anatomy.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4:
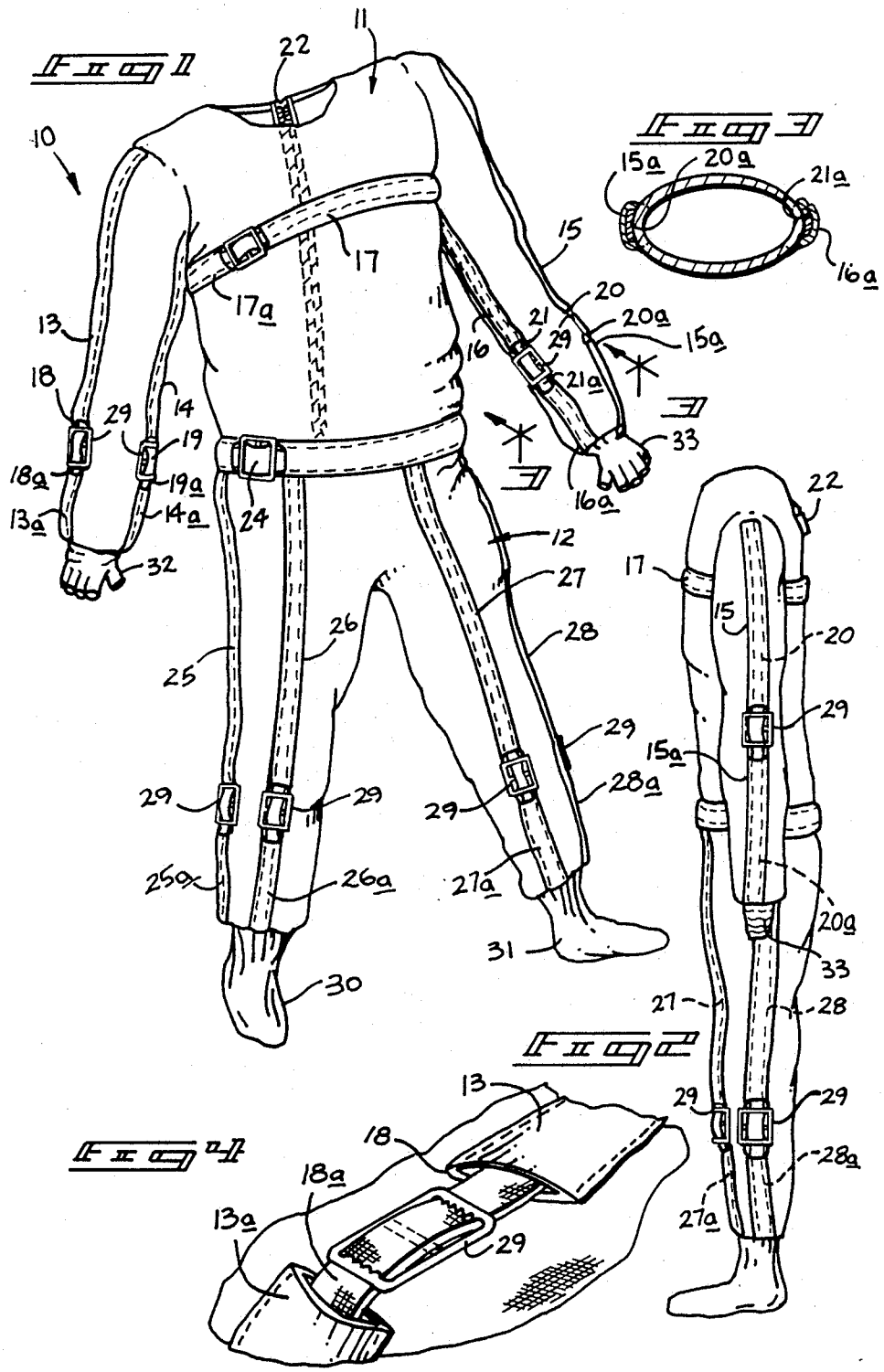
FIG. 1 is an isometric illustration of the instant invention.
FIG. 2 is a side orthographic view taken in elevation of the instant invention.
FIG. 3 is an orthographic view taken along the lines 3—3 of FIG. 1 in the direction indicated by the arrows.
FIG. 4 is an isometric illustration in section of a buckle arrangement utilized by the instant invention.

With reference now to the drawings, and in particular to FIGS. 1 to 4 thereof, a new and improved exercise suit embodying the principles and concepts of the present invention and generally designated by the reference numeral 10 will be described.

More specifically, the present invention comprises an exercise suit 10 of unitary construction including a torso portion and pants 12 joined together by a medially positioned waist portion. The torso portion includes a series of conduits oversewn the exterior and interior sides of the arm portions of the torso including an upper and lower first arm conduit 13*a* and 13*b* respectively, with an upper and lower second arm conduit 14*a* and 14*b* respectively, an opposite sides a first arm side portion of the torso with a third upper and lower arm conduit 13*a* and 13*b* respectively, with a fourth upper and lower arm conduit 16*a* and 16*b* respectively, positioned on opposite sides of the second arm of the torso coextensive with the arm portion, as illustrated in FIG. 1. A fifth chest conduit 17 is formed with a first end with a second end 17*a* positioned adjacent the first chest conduit to include an encircling elastic band for securing and maintaining a predetermined pressure to the chest of a wearer of the exercise suit 10.

The first, second, third, and fourth arm conduits "A" and "B" include discrete upper and lower bands respectively 18*a* and 18*b*, 19*a* and 19*b*, 20*a* and 20*b*, and 21*a* and 21*b* that are secured together by serrated tooth buckles 29. The upper and lower elastic band portions are thereby adjustable to provide a predetermined tension onto the band and thereby provide a desired preload or tension determining the level of exercise of a wearer of the suit 10. A zipper 22 is positioned onto a rear portion of the torso 11 to enable easy entry of the suit by a user thereof.

A sixth waist conduit 26 includes an elastic waist band 24 provided with a buckle to maintain the suit 10 at a predetermined orientation relative to a user. The suit fabric is generally formed of a stretchable fabric material, such as nylon, and may be formed with an interior cotton laminate (not shown) to enhance comfortable wear of the exercise suit 10.

The pants 12 of the exercise suit 10 include an upper and lower seventh leg conduit 25*a* and 25*b* along a side portion of the leg spaced from a forward upper and lower eighth leg conduit 26 about a first leg of the pants 12 with an eighth and ninth upper and lower leg conduit 26 and 27 similarly spaced about a second leg of the pants 12, also provided with upper and lower elastic bands securable together by buckles 29 to provide a predetermined tension and effective exercise level by a wearer of the exercise suit 10. To this end a respective 10th and 11th conduit comprising an upper and lower conduit 34 and 34*a*, respectively are secured to the back surface of each leg of pants 12 (see FIG. 2).

FIG. 4 is illustrative of the first upper and lower arm conduits 13*a* and 13*b* with included elastic bands therein adjustably secured by buckle 29, but is indicative of the adjustment arrangement of the various buckles 29 as they join the various elastic bands together throughout the arms and legs of the exercise suit 10.

The pants 12 include a first and second enclosed foot 30 integrally secured to the first and second legs of the pants wherein similarly a first and second fingerless glove 32 and 33 are secured to the respective arms of the torso portion 11 of the apparatus. The integrally secured gloves and feet portions of the suit maintain the suit configuration and effect the advantageous use of the various elastic bands and the adjustable tension arrangement effected by the use of the bands.

In this manner in use, the suit allows adjustment of the various bands within the various conduits to impart a predetermined tension onto the elastic bands and thereby enables an effective exercise level imparted to an individual during wearing of the suit.

The manner of usage and operation of the instant invention therefore should be apparent from the above description and accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An exercise suit for use by an individual comprising, a torso member for covering the upper torso and arms of the individual, and a pants member overfitting the lower torso and legs of the individual, and wherein the torso and pants members each include a plurality of conduits integrally secured to the exterior surface of the torso and leg members and further include a plurality of elastic bands within said conduits for effecting exercise of the individual when the individual dynamically exerts force to counter tension force of the elastic bands, and wherein a torso member includes a plurality of integrally formed arms wherein each arm includes a plurality of upper conduits and a plurality of lower conduits wherein an elastic band is positioned within each upper and lower conduit with a buckle means positioned between respective upper and lower conduits for securing the bands together and adjusting tension force within the bands, and wherein the pants member includes a first and second leg portion wherein each leg portion includes a plurality of upper and lower conduits with an elastic band positioned in each of said upper and lower conduits and a buckle adjustably securing the bands together for adjusting tension force within the bands, wherein said buckle is positioned between opposed terminal ends of a respective upper and lower conduit, and wherein the upper and lower conduits secured to the arm portions are mounted on opposite sides of the arm portions, and wherein the upper and lower conduits secured to the leg portions are mounted on respective side faces and forward faces of the leg portions, and wherein a further conduit is positioned about a waist portion securing the torso member and pants member together and further including a chest conduit for including an elastic band therein wherein the bands positioned within the waist and chest conduits are adjustable by means of a buckle to vary a tension force applied to the chest and waist of the exercise suit, and wherein each arm portion includes an integrally formed fingerless glove secured at a terminal end of each arm portion and each leg portion of the pants members includes an integrally secured foot portion to maintain the orientation of the exercise suit about the individual.

2. An exercise suit as set forth in claim 1 wherein a zipper is positioned onto a rear face of the torso member to enable ease of access into the exercise suit by the individual.

* * * * *